US005388769A

United States Patent [19]

Rodrigo et al.

[11] Patent Number: 5,388,769

[45] Date of Patent: Feb. 14, 1995

[54] SELF-CLEANING IONIZING AIR GUN

[75] Inventors: Richard D. Rodrigo, Line Lexington; Timothy A. Good, Royersford, both of Pa.

[73] Assignee: Illinois Tool Works Inc., Glenview, Ill.

[21] Appl. No.: 123,927

[22] Filed: Sep. 20, 1993

[51] Int. Cl.[6] ..... H05F 3/00; H01T 23/00

[52] U.S. Cl. ..... 239/690; 239/708; 239/104; 361/213; 361/227; 361/231

[58] Field of Search ..... 239/690, 704, 706, 708, 239/DIG. 21, 104, 106; 361/227, 228, 213, 231

[56] References Cited

U.S. PATENT DOCUMENTS

| | | | |
|---|---|---|---|
| 3,156,847 | 11/1964 | Schweriner | 361/213 |
| 3,179,849 | 4/1965 | Schweriner | 361/213 |
| 4,317,661 | 2/1982 | Sasaoka et al. | 361/231 |
| 4,333,123 | 6/1982 | Moulden | 361/213 |
| 4,339,782 | 7/1982 | Yu et al. | 361/229 |
| 4,417,293 | 11/1983 | Larigaldie | 361/212 |
| 4,498,116 | 2/1985 | Saurenman | 361/213 |
| 4,834,297 | 5/1989 | Cumming et al. | 239/690 |

*Primary Examiner*—Karen B. Merritt
*Attorney, Agent, or Firm*—Stanley Bilker

[57] ABSTRACT

A self-cleaning, anti-fouling, ionizing air gun for static neutralization and particle blow-off comprises a generally tubular barrel having an open forward or nozzle end and a rearward open end for drawing air therethrough from the atmosphere. A pointed ion emitting electrode is positioned intermediate the ends of the barrel and directs ions toward the forward nozzle end while a plurality of circumferentially spaced air jets direct streams of compressed air in a conical pattern toward the apex thereof in front of the ion emitting electrode so as to induce air drawn in from the open rear end over the electrode to effect cleansing thereof thereby expelling a high velocity ionized air stream through the forward nozzle end.

10 Claims, 2 Drawing Sheets

SELF-CLEANING IONIZING AIR GUN

BACKGROUND OF THE INVENTION a) Field of the Invention

This invention relates to ionizing air guns or nozzles in which a high velocity stream of air is directed over an ionizing emitter electrode to expel an ionized stream of air toward a target area to effect static neutralization of charged particles and removal thereof from the targeted surface. More particularly, this invention relates to an ionizing air gun which employs a compressed gas for discharging a high velocity stream of ionized air against a surface in order to neutralize and blast charged particles from a selected area.

b) Prior Art

In prior U.S. Pat. Nos. 3,156,847 and No. 3,179,849, there is shown and described ionizing air guns or nozzles in which an A.C. high voltage generator or power supply is connected directly or capacitively across a pointed needle electrode coaxially disposed within the nozzle of the gun's barrel. A stream of air from a compressed air line is directed through the nozzle parallel with the needle axis and becomes ionized in its passage through the conically radiating high voltage field. Since the air stream reinforces the pattern of the ioning field, an extended range of ionized air is delivered from the nozzle so as be highly effective both in dislodging particles clinging to a surface by electrostatic attraction and in neutralizing charges on the particles and/or on the surfaces preventing reattraction.

In the above cited prior art as well as in the patent art set forth below, compressed air or gas from a cylinder or tank is utilized as the source for expelling the high velocity air through the nozzles:

| Patentee | U.S. Pat. No. |
|---|---|
| MOULDEN | 4,333,123 |
| LARIGALDIE | 4,417,293 |
| SAURENMAN | 4,498,116 |
| BLITSHTEYN | 4,665,462 |
| CUMMING | 4,834,297 |

c) Objectives of This Invention

Ion emitter points by virtue of the high voltage imposed on them and because of their geometric configuration tend to attract dust from the atmosphere. The dust is electrostatically attracted to and collects on the sharp tip of the ion emitter point due to the high electric field required for the ionization process. The dust typically collects as a small sphere on the pointed tip, which as it accumulates interferes with the ionization process. When sufficient dust has accumulated, ionization will cease since the point is no longer effectively sharp to cause breakdown of the air dielectric.

Existing devices typically mount the ion emitter point directly in the jet of compressed air. Since compressed air usually contains contaminants, such as water, oil and dirt, the emitter point when directly exposed to such contaminants becomes itself contaminated and dirty. Such contaminants tend to accumulate as a film on these ionizing elements and often lead to conductive paths causing fouling that reduces high voltage or produce arcing, degradation and burn-out. If the emitter point is mounted aside the jet of compressed air, the velocity of the air flowing over the point is insufficient to clean off dust electrostatically attracted to the point, consequently requiring such maintenance as brushing to keep the point clean.

It is therefore an object of this invention to avoid exposure of the ion emitter point to potentially contaminated compressed air streams.

Another object of this invention is to provide an ionizing air gun which will steer the compressed air in a path forward of the emitter point and draw in ambient air from the rear thereof over said point at a velocity high enough to keep said point clean.

Still another object of this invention is to provide a self-cleaning ionizing air gun wherein a plurality of circumferentially spaced compressed air jets are directed in a conical pattern in front of the pointed emitter electrode to draw high velocity ambient over said emitter electrode from the rear of the gun so as to scour accumulated dust therefrom and expel ionized air from the forward end.

Other objects of this invention are to provide an improved device of the character described which is easily and economically produced, sturdy in construction and highly efficient and effective in operation.

SUMMARY OF THE INVENTION

This invention comprises a self-cleaning, anti-fouling ionizing air gun for static neutralization embodying a tubular barrel having a forward exit end in the form of a nozzle and an open rearward end for drawing ambient air into the barrel over a pointed ion emitter electrode medially disposed within the barrel. A plurality of circumferentially spaced jets from a high pressure compressed air source directs a conical pattern of high velocity air in front of the emitter electrode to induce ambient air from the rear of the barrel to flow over the ionizing electrode and cleansing it of contamination. The mixed high velocity air is expelled with great force from the front end to neutralize charged particles on the targetted article surface and effect removal thereof.

BRIEF DESCRIPTION OF THE FIGURES

With the foregoing objects in view, this invention consists of the details of construction and combination of parts as will be more fully understood from the following detailed description when read in conjunction with the accompanying drawing, in which.

DETAILED DESCRIPTION

Figure 1:
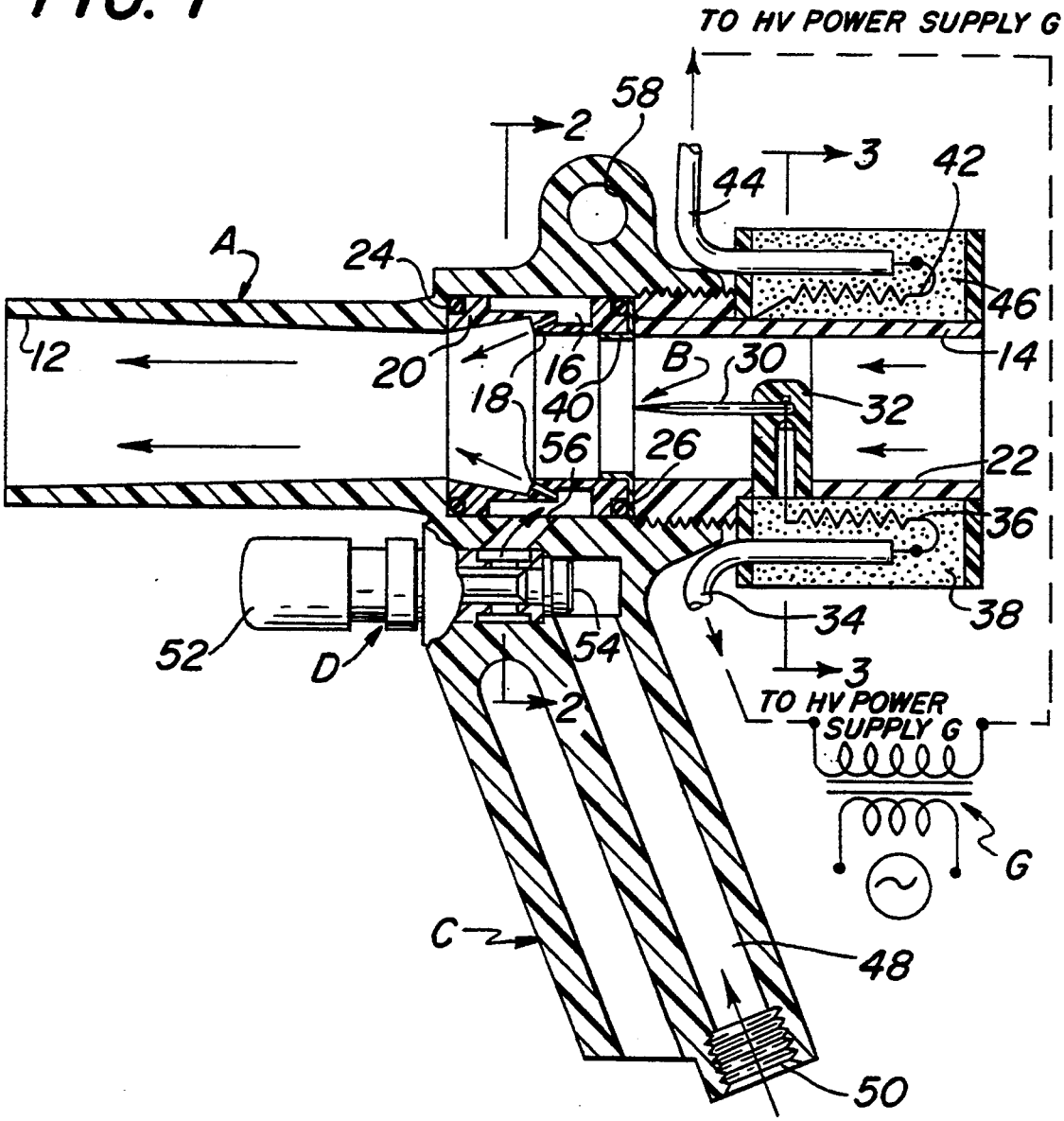
FIG. 1 is a side sectional view of an ionizing air gun embodying this invention.
Figure 2:
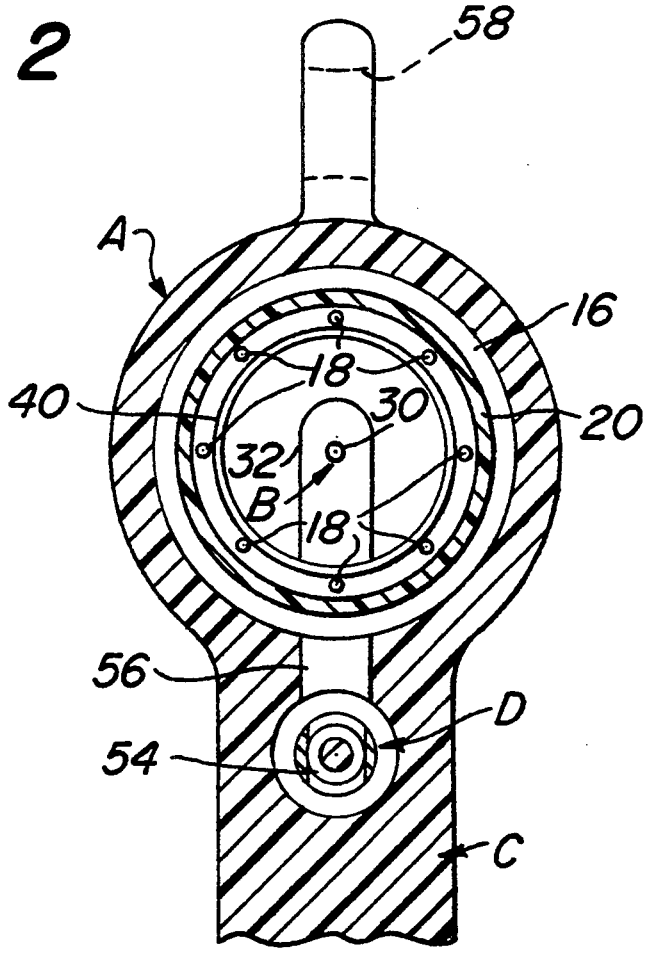
FIG. 2 is a sectional view taken along line 2—2 of FIG. 1.
Figure 3:
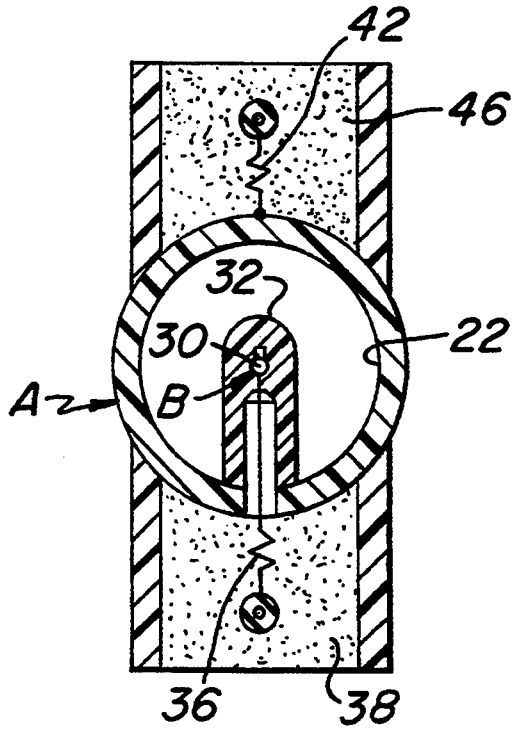
FIG. 3 is a sectional view taken along line 3—3 of FIG. 1.

Referring now in greater detail to the drawings in which similar reference characters refer to similar parts, there is shown an ionizing air gun for static neutralization and blow-off of charged particles electrostatically adhered to a surface, comprising a barrel, generally designated as A, an ion emitting electrode B mounted in a medial portion of the barrel A, and a grip assembly C for hand holding the gun and directing a stream of high velocity air toward a desired location.

The barrel A is molded of a suitable insulated plastic material, such as a polycarbonate resin, and includes an open forward open end or nozzle 12 for expelling air at high velocity. The rearward portion of the gun is also open at 14 to permit drawing in of ambient air from the outside when compressed air is admitted into a peripheral chamber 16 and expelled as high velocity jets through a plurality of circumferentially spaced ports 18. The jet ports 18 are so oriented to define a pattern directed toward the apex of a cone pointed toward the open nozzle end 12. When the jets 18 discharge compressed air, ambient air is drawn through the rear open end 14 of the barrel A and then washes over the ion emitter B for discharge through the open nozzle end 12 at high velocity along with the conical jet stream produced by the ports 18. The chamber 16 is formed by an annular recess defined about a tubular insert 20 when forced into the interior of the barrel A by an insulated plastic nipple 22, such as nylon, threaded into the rearward portion thereof. Suitable O-rings seals 24 and 26 seated in complementary grooves act as resilient closures for the high pressure chamber 16 to prevent compressed air leakage.

The emitter electrode B includes a pointed pin electrode 30 which is mounted on a post 32 upstanding from the insulated nipple 22. The pin electrode 30 is of a suitable conductive material, such as stainless steel, connected to the high voltage side of a high voltage power supply by way of a cable 34 and resistor 36, the latter being encapsulated by a potting compound in recess 38. The reference electrode 40 constitutes a ring shaped member co-axially surrounding the point of the needle electrode 30 and is connected to the opposite side of the power supply or high voltage transformer G by way of high voltage resistor 42 and cable 44. Recess 46 is filled with potting compound similar to recess 38 to encapsulate the resistor 42. Thus, a high voltage field is created in the gap between point of the pin electrode 30 and the periphery of the ring electrode 40 to generate ions in a generally radiating pattern toward the exit nozzle end 12 of the barrel A.

The high voltage power supply G comprises any suitable A.C. power source, as for example a generator shown in U.S. Pat. No. 3,156,847, delivering an A.C. high voltage of approximately 5,000 to 15,000 volts across the lead wires 34 and 44. If a balanced ion emission is desired, a floating reference electrode of the type shown in our prior U.S. Pat. No. 5,153,811 may be utilized.

The grip C contains a longitudinally extending bore 48 which is adapted to be coupled to a high pressure cylinder or tank (not shown) by way of a threaded union 50. A trigger D having a presser button 52 enables a valve 54 to connect the bore 48 with an internal passageway 56 leading to the chamber 16 thereby squirting the jets of compressed air through ports 18 in a conical pattern in front of the emitter tip 30. An eyelet 58 at the top of the barrel A allows the ionizing air gun to be conveniently hung.

As is apparent from the foregoing description, actuating the button 52 of trigger assembly D in hand grip C allows compressed air from the cylinder or tank which is coupled to passageway 48 by way of union 50 to be admitted to the chamber 16. The discharge of this compressed air through the ports 18 causes a conical pattern of air to be expelled in front of the pin electrode 30, the ionization therefrom reinforcing the air discharge. At the same time, air will be drawn from the atmosphere and wash over the pin electrode to effect cleansing thereof so that ionized air will be expelled through the nozzle 12 at the target area.

We claim:

1. A self-cleaning, anti-fouling ionizing air gun for static neutralization, comprising:

a barrel having a rearward end for drawing ambient air from the outside into the barrel and a forward nozzle end for discharging high velocity ionized air toward a target area, ion emitter electrode means positioned at a medial portion of said barrel, and means constituting at least one jet of compressed air positioned in front of said electrode means and drawing ambient air from outside the barrel over said electrode means to effect cleansing thereof without causing contaminants in the compressed air to impinge directly upon said ion emitter electrode means.

2. The ionizing air gun of claim 1 wherein said ion emitter electrode means comprises a pointed conductive tip, and a conductive ring spaced thereabout in insulated disposition therewith, and means for connecting an A.C. high voltage power supply across said tip and said ring whereby ions will be radially emitted from said tip toward said ring in a direction generally toward said nozzle end.

3. The ionizing air gun of claim 1 wherein said means constituting at least one jet of compressed air comprises a chamber at the periphery of said barrel and a plurality of spaced ports in said chamber communicating with the interior of the barrel in a direction generally toward the nozzle end.

4. The ionizing air gun of claim 3 wherein said chamber is annularly disposed about said barrel.

5. The ionizing air gun of claim 4 wherein said ports are circumferentially spaced and configured in a generally conical pattern converging toward the conical apex of the pattern.

6. A self cleaning, anti-fouling ionizing air gun for static neutralization comprising a tubular barrel having an open forward end and an open rearward end for drawing ambient air into said barrel, a pointed ion emitter electrode positioned at a medial portion in said barrel and having a pointed tip directed toward the open forward end, means constituting at least one jet of compressed air positioned in front of the pointed tip of said ion emitter electrode, said ion emitter electrode propelling a stream of ionized air at high velocity through the open forward end of the barrel and inducing ambient air from the rearward end to wash over said ion emitter electrode to effect cleansing thereof.

7. The ionizing air gun of claim 6 wherein the means constituting at least one jet of compressed air comprises a chamber having circumferentially spaced ports expelling air in a generally conical pattern toward the conical apex thereof.

8. The ionizing air gun of claim 7 wherein the ion emitter electrode is axially disposed within said barrel.

9. A self-cleaning, anti-fouling ionizing air gun for static neutralization of charged particles adhered to a surface, comprising:

a tubular barrel having an open rearward end for admission of ambient air and an open forward end acting as a nozzle for expelling high velocity air therethrough, an ion emitting electrode at a medial portion in said barrel, including means for connecting said ion emitting electrode to an A.C. high voltage power source, an annular chamber peripheral to said barrel, a plurality of circumferentially spaced ports in said chamber and communicating with the interior of said barrel at a position in front of said ion emitting electrode, and means for coupling said chamber to a source of compressed air, whereby compressed air discharged through said ports will cause ambient air to be drawn into said barrel to wash over said ion emitting electrode and effect cleansing thereof and thereafter to be expelled at high velocity through said forward open end of said barrel.

10. The ionizing air gun of claim 9 wherein said ion emitting electrode comprises a pointed tip coupled to one side of the high voltage power source and a reference electrode in the configuration of a ring electrode coaxially supported about said pointed tip to define a high voltage field in the gap therebetween forming radially extending lines of force synergistically supporting the air directional velocity.

* * * * *